US005921152A

United States Patent [19]

Wang

[11] Patent Number: 5,921,152

[45] Date of Patent: Jul. 13, 1999

[54] OPTIONAL MULTI-RATIO GEAR TRANSMISSION SYSTEM

[75] Inventor: Jifeng Wang, Westborough, Mass.

[73] Assignee: Morgan Construction Company, Worcester, Mass.

[21] Appl. No.: 09/017,828

[22] Filed: Feb. 3, 1998

[51] Int. Cl.[6] ..... F16H 37/06

[52] U.S. Cl. ..... 74/665 GA; 72/249; 72/248

[58] Field of Search ..... 72/249, 248; 74/665 GA

[56] References Cited

U.S. PATENT DOCUMENTS

| | | | |
|---|---|---|---|
| 3,580,033 | 5/1971 | Gay | 72/205 |
| 3,686,919 | 8/1972 | Brusa | 72/249 |
| 4,024,746 | 5/1977 | Brück | 72/249 |
| 4,136,545 | 1/1979 | Wilson | 72/238 |
| 4,325,245 | 4/1982 | Sherwood | 72/248 |
| 4,669,294 | 6/1987 | Wilson | 72/249 |
| 4,831,857 | 5/1989 | Levy et al. | 72/181 |
| 4,848,185 | 7/1989 | Möltner et al. | 74/674 |
| 4,939,919 | 7/1990 | Chezzi | 72/249 |
| 5,076,088 | 12/1991 | Klingen et al. | 72/214 |
| 5,078,000 | 1/1992 | Matsuo et al. | 72/249 |
| 5,230,236 | 7/1993 | Nakamura et al. | 72/205 |
| 5,595,083 | 1/1997 | Shore | 72/249 |

*Primary Examiner*—Charles A. Marmor
*Assistant Examiner*—Tisha D. Waddell
*Attorney, Agent, or Firm*—Samuels, Gauthier & Stevens

[57] ABSTRACT

Successive roll stands in a rolling mill are driven at selectively different drive speed ratios by a transmission system having a pair of drive shafts and a least one idler shaft journalled for rotation about parallel axes. First and second gear trains each include intermeshed drive gears freely rotatable on the drive shafts, and a pair of idler gears on the idler shaft; each being in meshed engagement with at least one of the drive gears of each drive train. Clutches operated to selectively couple the drive gears of the first and second drive trains with their respective drive shafts.

5 Claims, 3 Drawing Sheets

OPTIONAL MULTI-RATIO GEAR TRANSMISSION SYSTEM

BACKGROUND OF THE INVENTION

1. Field of the Invention

This invention relates generally to continuous rolling mills of the type which produce rods, bars and the like, and is concerned in particular with an improved apparatus for driving successive roll stands at selectively different speed ratios.

2. Description of the Prior Art

In modern day rolling mills operating with widely varying rolling schedules and at extremely high speeds exceeding 100 m/sec., there is a growing need to drive successive roll stands with selectively different drive ratios. This is particularly true in rod mills, where so-called "mini" blocks are employed to further reduce and/or size entire families of products by selectively rendering inoperative or "dummying" preceding stands along the rolling line. The gear boxes of existing drive trains have various drawbacks and are either unable to adapt to the wide ranging demands imposed by current rolling schedules, or they are excessively large and expensive.

An objective of the present invention is to provide an improved gear transmission system which is readily adaptable to driving successive roll stands at multiple selectively different drive speed ratios.

Companion objectives include the provision of a multiple ratio gear box which is both compact and low cost as compared to conventional designs.

SUMMARY OF THE INVENTION

The gear transmission system of the present invention includes a pair of drive shafts and at least one idler shaft, all journalled for rotation about parallel axes. The drive shafts are adapted for coupling to the input shafts of two successive roll stands on a mill pass line, and one of the drive shafts or the idler shaft is additionally adapted to be driven by an external source, e.g., the output shaft of an associated gear box or a drive motor. First and second gear trains each comprise drive gears freely rotatable on the drive shafts, and an idler gear fixed to the idler shaft for rotation therewith. At least some of the gears in each gear train have different numbers of teeth. Clutches are employed to selectively couple the drive gears of each gear train with their respective drive shafts, resulting in the drive shafts coupled to the input shafts of two successive stands being driven at selectively different drive speed ratios.

These and other features, objectives and advantages of the present invention will become more apparent as the description proceeds with reference to the accompanying drawings wherein:

DETAILED DESCRIPTION OF THE ILLUSTRATED EMBODIMENTS

Figure 1:
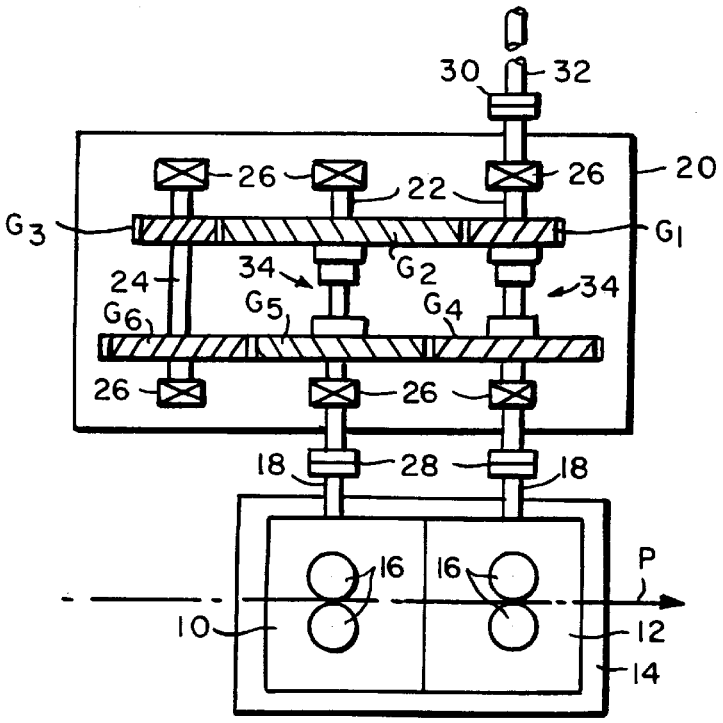
FIG. 1 is a diagrammatic illustration of a gear box in accordance with the present invention, with its drive shafts coupled to the input shafts of two successive roll stands in a rolling mill.
Figure 2:
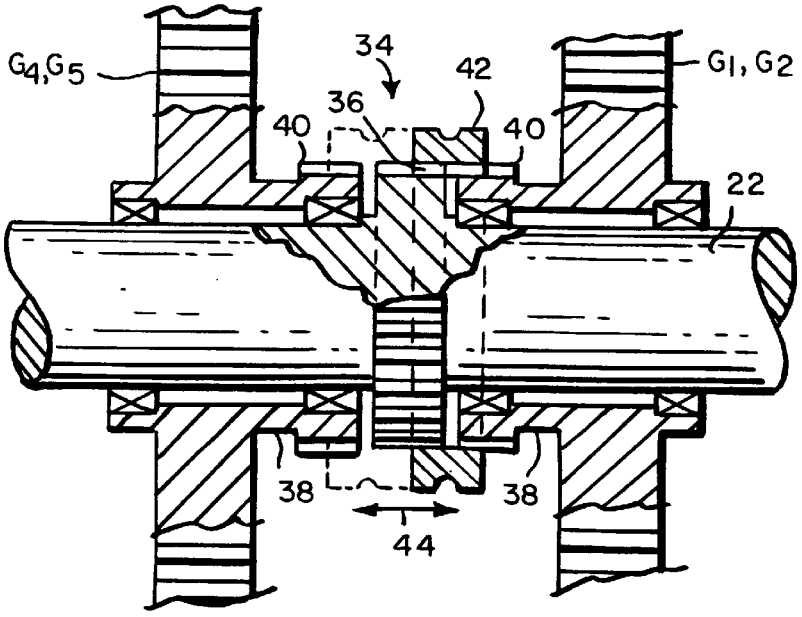
FIG. 2 is a sectional view on an enlarged scale taken through one of the clutch assemblies shown in FIG. 1.

Referring initially to FIGS. 1 and 2, two roll stands 10, 12 are shown positioned successively along a mill pass line P. Typically, the roll stands will be grouped together into a "block" 14, and each will include a pair of work rolls 16. The work rolls are mounted in cantilever fashion on the exposed ends of roll shafts contained within the stand housings. The roll shafts are driven by internal gearing via input shafts 18. Although not shown, it will be understood that the work rolls of the successive stands have their axes staggered by 90° in order to effect twist free rolling. All of this, including the internal drive arrangements for the roll stands, is well known to those skilled in the art and thus does not require any further explanation. See for example U.S. Pat. Nos. 5,577,405 and 5,280,714, the disclosures or which are incorporated herein by reference.

A gear box containing a transmission system in accordance with the present invention is shown at 20. The gear box contains a pair of drive shafts 22, and in this embodiment, one idler shaft 24. Bearings indicated typically at 26 serve to journal the drive and idler shafts 22, 24 for rotation about parallel axes.

Couplings 28 connect the drive shafts 22 to the input shafts 18 of the roll stands, and one of the drive shafts is additionally coupled as at 30 to the output shaft 32 of another associated gear box or drive motor (not shown).

A first gear train includes intermeshed drive gears $G_1$, $G_2$ freely rotatable on the drive shafts 22, and an idler gear $G_3$ fixed relative to the idler shaft 24 and in meshed engagement with drive gear $G_2$. A second gear train similarly includes intermeshed drive gears $G_4$, $G_5$ freely rotatable on the drive shafts, and an idler gear $G_6$ fixed relative to the idler shaft and in meshed engagement with drive gear $G_5$. Clutch assemblies 34 are interposed between the freely rotatable drive gears on each of the drive shafts.

As can best be seen in FIG. 2, each clutch assembly includes an externally toothed circular shoulder 36 on the drive shaft 22. The adjacent drive gears have cylindrical hubs 38 which terminate at similarly configured externally toothed circular shoulders 40. An internally toothed sleeve 42 is permanently engaged with the external teeth of the shoulder 36 on shaft 22, and is axially adjustable in opposite directions as indicated at 44 to selectively engage one or the other of the externally toothed shoulders 40 of the adjacent drive gears, thereby effecting selective alternative coupling of the drive gears to their respective drive shaft.

Figure 3A:
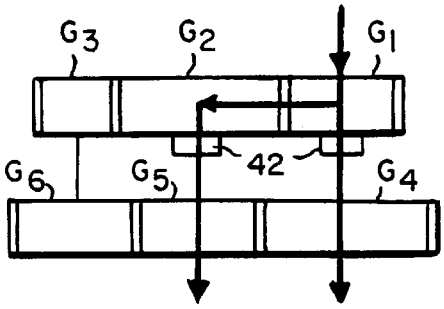
FIGS. 3A–3D are schematic illustrations depicting the various relative ratios available between two output shafts with the gear box shown in FIG. 1.
Figure 3B:
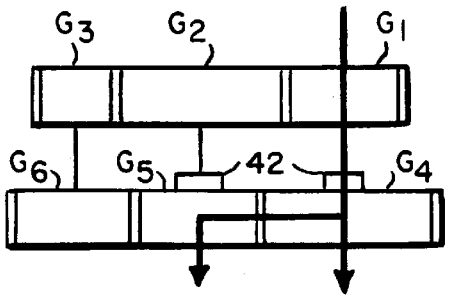
Figure 3C:
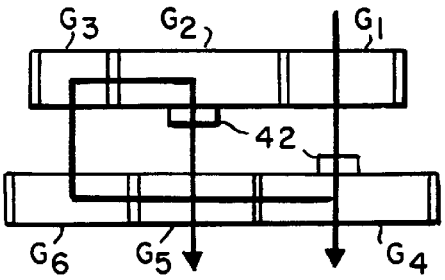
Figure 3D:
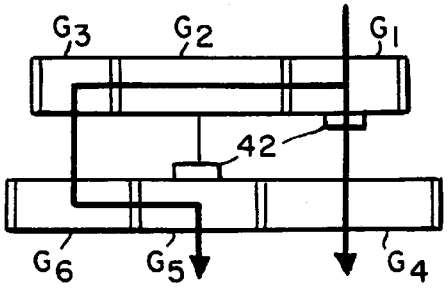

The drive gears $G_1$ and $G_2$ have different numbers of teeth, as do the drive gears $G_4$ and $G_5$ and the idler gears $G_3$ and $G_6$. FIGS. 3A–3D illustrate the different drive ratios available with the transmission system shown in FIG. 1. For example, with the clutch sleeves 42 adjusted to the positions shown in FIG. 3A, the resulting drive ratio will be provided by gears $G_1$ and $G_2$. In FIG. 3B, the drive ratio is provided by gears $G_4$ and $G_5$. In FIG. 3C, the drive ratio is provided by drive gears $G_2$ and $G_4$, and in FIG. 3D by drive gears $G_1$ and $G_5$.

It will thus be seen that with a compact arrangement of three shafts and six gears, four different drive ratios between two output shafts are selectively achievable by simply adjusting two clutches.

Figure 4A:
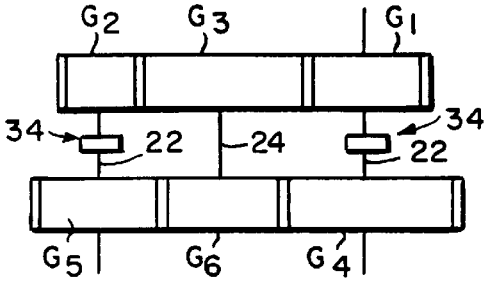
FIGS. 4A and 4B are schematic illustrations depicting placement of the idler shaft and gears at alternative locations.
Figure 4B:
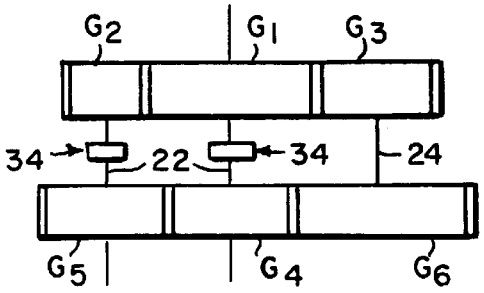
Figure 5:
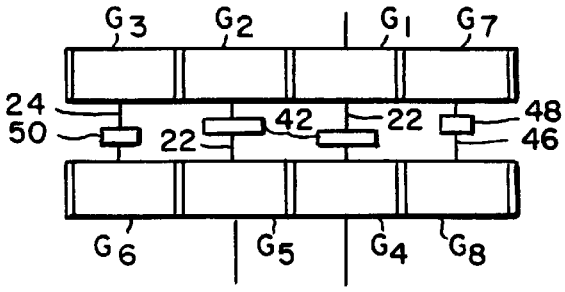
FIG. 5 schematically depicts another embodiment incorporating multiple idler shafts.
Figure 6:
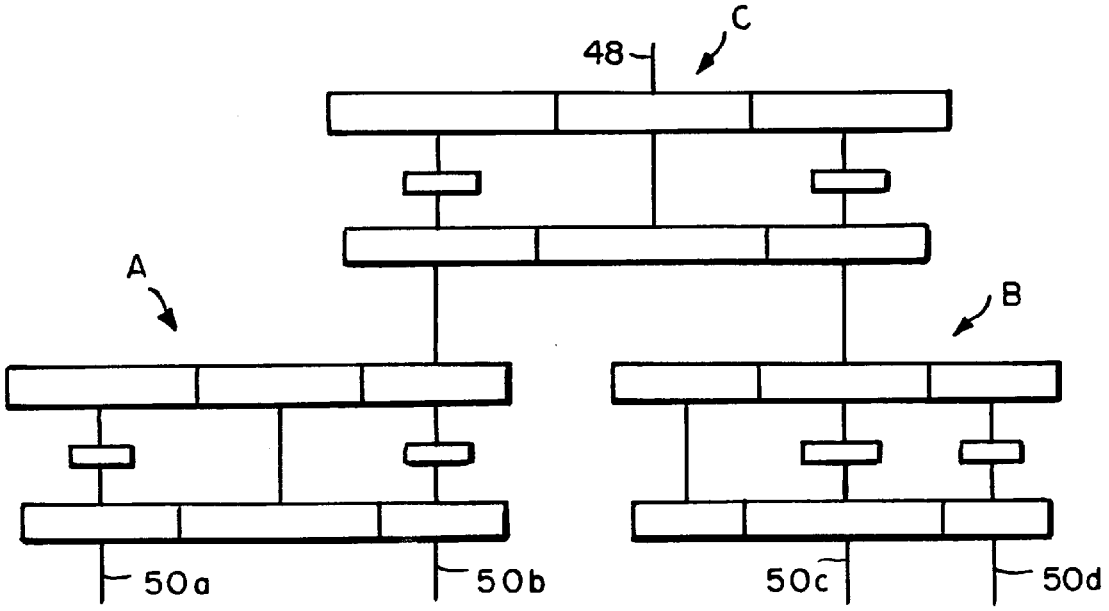
FIG. 6 depicts the application of the invention to a four stand rolling block.

The present invention is easily adaptable to different equipment layouts, as depicted for example in FIGS. 4A and 4B which show the idler shaft 24 at different locations. Moreover, as depicted in FIG. 5, by adding an additional idler shaft 46 with idler gears $G_7$, $G_8$ and clutch 48, and by making the idler gears G3, G6 freely rotatable on idler shaft 24 with an additional clutch 50 operative therebetween, a total of six different gear ratios can be achieved. The concept can be expanded even further by adding additional idler shafts, idler gears and clutches. Other expanded applications are possible by repeatedly using either the embodiments disclosed herein, or modified embodiments encompassed by the scope of the appended claims. For example, as depicted in FIG. 6, three gear transmission systems A, B and C of the types described above can be coupled together, with one input shaft 48 providing power to four output shafts $\mathbf{50}_a$, $\mathbf{50}_b$, $\mathbf{50}_c$ and $\mathbf{50}_d$ driving four successive roll stands (not shown). With this arrangement, four ratios are available between shafts $\mathbf{50}_a$ and $\mathbf{50}_b$, between shafts $\mathbf{50}_b$ and $\mathbf{50}_c$, and between shafts $\mathbf{50}_c$ and $\mathbf{50}_d$, for a total of sixty four different speed combinations for the four stand sequence.

I claim:

1. In a rolling mill having two roll stands positioned successively along a mill pass line, each roll stand being driven by an input shaft, an apparatus for driving said roll stands at selectively different speed ratios, said apparatus comprising:

a pair of drive shafts and at least one idler shaft;

means for journalling said drive shafts and said idler shaft for rotation about parallel axes;

means for coupling each of said drive shafts to one of said input shafts;

means for driving one of said drive shafts;

a first drive gear freely rotatable on each of said drive shafts and a first idler gear on and fixed relative to said idler shaft, said first drive gears and said first idler gear being in an intermeshed relationship to provide a first gear train;

a second drive gear freely rotatable on each of said drive shafts and a second idler gear on and fixed relative to said idler shaft, said second drive gears and said second idler gear being in an intermeshed relationship to provide a second gear train; and clutch means for selectively coupling the drive gears of said first and second drive trains to their respective drive shafts.

2. The apparatus as claimed in claim 1 wherein said clutch means is operative to alternatively couple either the first or second drive gear with each respective drive shaft.

3. The apparatus as claimed in claim 1 wherein the drive gears of each drive train are in mesh with each other, and the idler gear of each drive train is in mesh with only one of said drive gears.

4. The apparatus as claimed in claim 1 wherein the idler gear of each drive train is interposed between said drive gears.

5. Apparatus for driving two input shafts at selectively different speed ratios with a single output shaft, said apparatus comprising:

a pair of drive shafts and at least one idler shaft, said drive shafts and idler shaft being journalled for rotation about parallel axes;

means for coupling each drive shaft to a respective one of said input shafts;

means for coupling one of said drive shafts to said output shaft;

a first drive gear freely rotatable on each of said drive shafts and a first idler gear on and fixed relative to said idler shaft, said first drive gears and said first idler gear being in an intermeshed relationship to provide a first gear train;

a second drive gear freely rotatable on each of said drive shafts and a second idler gear on and fixed relative to said idler shaft, said second drive gears and said second idler gear being in and intermeshed relationship to provide a second gear train; and clutch means for selectively coupling the drive gears of said first and second drive trains to their respective drive shafts.

* * * * *